US007150163B1

(12) United States Patent
McAllister

(10) Patent No.: US 7,150,163 B1
(45) Date of Patent: Dec. 19, 2006

(54) WATER COOLER ENCLOSURE

(76) Inventor: Andrea H. McAllister, 35 Marathon Dr., Woolwich Township, NJ (US) 08085

( * ) Notice: Subject to any disclaimer, the term of this patent is extended or adjusted under 35 U.S.C. 154(b) by 86 days.

(21) Appl. No.: 11/010,459

(22) Filed: Dec. 13, 2004

(51) Int. Cl.
*B67D 5/62* (2006.01)

(52) U.S. Cl. ..... 62/389; 312/290; 312/326

(58) Field of Classification Search ..... 62/337–339, 62/389–400; 312/237, 290, 249.8, 326–329
See application file for complete search history.

(56) References Cited

U.S. PATENT DOCUMENTS

| | | | | | |
|---|---|---|---|---|---|
| 3,060,703 | A | * | 10/1962 | Benua et al. | 62/394 |
| 3,237,810 | A | | 3/1966 | Gran | |
| 3,456,847 | A | * | 7/1969 | Scott | 222/95 |
| 3,641,785 | A | * | 2/1972 | Portz | 62/396 |
| 3,786,648 | A | * | 1/1974 | Rice | 62/200 |
| 3,811,294 | A | * | 5/1974 | Taylor | 62/390 |
| 3,843,021 | A | * | 10/1974 | Schieser | 222/105 |
| 4,153,181 | A | * | 5/1979 | Parker et al. | 222/61 |
| D266,056 | S | | 9/1982 | Lear | |
| 4,600,148 | A | * | 7/1986 | Raymer et al. | 239/29.3 |
| 4,834,250 | A | | 5/1989 | Dumbeck et al. | |
| 4,866,945 | A | | 9/1989 | Bender et al. | |
| 4,895,418 | A | | 1/1990 | Medellin et al. | |
| D316,003 | S | * | 4/1991 | Clevenger | D7/306 |
| D317,544 | S | * | 6/1991 | Bermingham | D7/307 |
| 5,065,879 | A | | 11/1991 | King | |
| 5,356,046 | A | | 10/1994 | Burke | |
| 5,454,492 | A | | 10/1995 | Hunter et al. | |
| 6,101,835 | A | * | 8/2000 | Butsch et al. | 62/390 |
| D434,581 | S | * | 12/2000 | Spann, Jr. | D6/445 |
| 6,155,460 | A | | 12/2000 | Lee | |
| 6,912,867 | B1 | * | 7/2005 | Busick | 62/338 |

* cited by examiner

*Primary Examiner*—William E. Tapolcai
(74) *Attorney, Agent, or Firm*—Norman E. Lehrer

(57) ABSTRACT

A water cooler and cabinet for enclosing the water cooler is disclosed. The water cooler includes a base and a bottle mounted thereon where the base contains an electrical refrigeration system and faucets for dispensing the water. The cabinet includes a top panel, a right side wall, a left side wall, a front door, a rear wall, and a bottom wall. The bottom wall of the cabinet has an inner surface and an outer surface with a plurality of wheels mounted on the outer surface. The front door of the cabinet has an opening through which the faucets are accessible. The rear wall of the cabinet has an opening through which the wiring of the electrical refrigeration system of the water cooler may be accessible.

3 Claims, 2 Drawing Sheets

WATER COOLER ENCLOSURE

BACKGROUND OF THE INVENTION

The present invention is directed toward an enclosure for a water cooler and more particularly, toward a cabinet that provides an aesthetically pleasing appearance for a water cooler.

Bottled water has become a staple in American households and offices. Often, individual bottles of water are kept in a refrigerator and dispensed or used as needed. However, individual bottles of water can be expensive to buy and can take up space in a refrigerator. Furthermore, individual bottles of water are not convenient to use if hot water is desired. For example, if a person desires to make a hot beverage such as instant coffee, tea, hot chocolate, or the like. When hot water is desired and a convenience such as a stovetop or microwave oven is not available, water coolers are often used. Water coolers typically dispense hot and cold water. Water coolers may be found in both commercial and residential settings.

Typically, a water cooler includes an upright base within which is contained a conventional, electric refrigeration system. The system has a cooling reservoir to receive the mouth of an inverted, five gallon water bottle and a network of outlet pipes and valves that aid in dispensing the water. The dispensed water may be chilled or heated.

Water coolers are commonly placed in obscure areas because of their large size and aesthetically unappealing appearance. However, they still tend to detract from the decor and overall appearance of the room.

Therefore, a need exists for a decorative yet functional enclosure for a water cooler that not only adds to the overall appearance of the room but is also utilitarian.

SUMMARY OF THE INVENTION

The present invention is designed to overcome the deficiencies of the prior art discussed above. It is an object of the present invention to provide an enclosure for a water cooler that is decorative as well as functional.

It is another object of the present invention to provide an enclosure for a water cooler that allows the water bottle to be easily removed and replaced.

It is a further object of the present invention to provide an enclosure for a water cooler that is movable.

In accordance with the illustrative embodiments demonstrating features and advantages of the present invention, there is provided an enclosure for a water cooler that essentially includes the combination of a water cooler and cabinet for enclosing the water cooler comprising a water cooler having a base and a bottle mounted thereon, the base contains an electrical refrigeration system and faucets for dispensing the water and a cabinet having a top wall or panel, a right side wall, a left side wall, a front door or panel, a rear wall, and a bottom wall. The bottom wall of the cabinet has an inner surface and an outer surface. The outer surface has a plurality of wheels mounted thereon. The front door has an opening through which the faucets are accessible. The front door is hingedly secured to one of the side walls. The top panel is hingedly secured to one of the walls. The rear wall has an opening through which the wiring of the electrical refrigeration system may be accessible.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
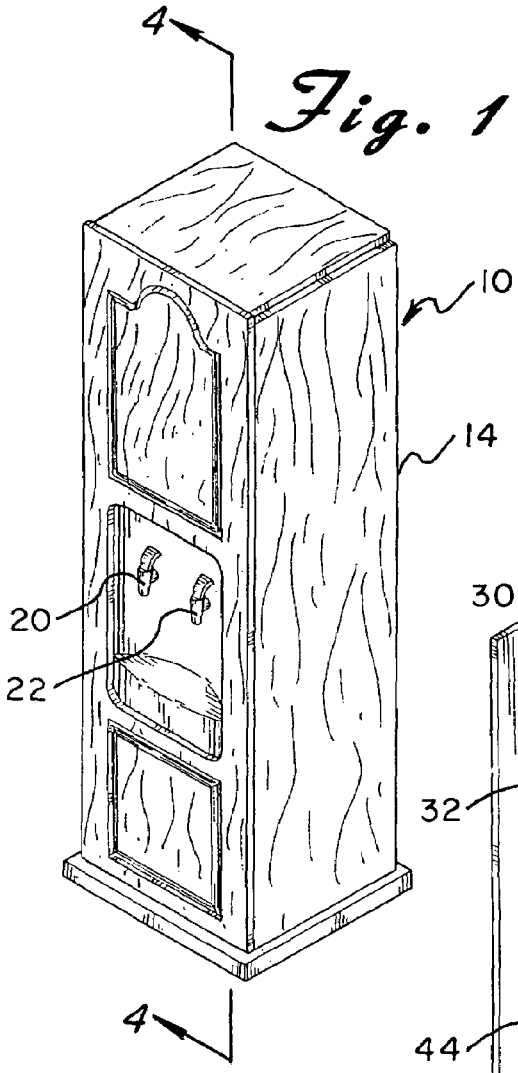
FIG. 1 is a top, front perspective view of the cabinet of the present invention.

Referring now to the drawings in detail wherein like reference numerals have been used throughout the various figures to designate like elements, there is shown in FIG. 1 a water cooler and cabinet for enclosing the same constructed in accordance with the principles of the present invention and designated generally as 10.

Figure 2:
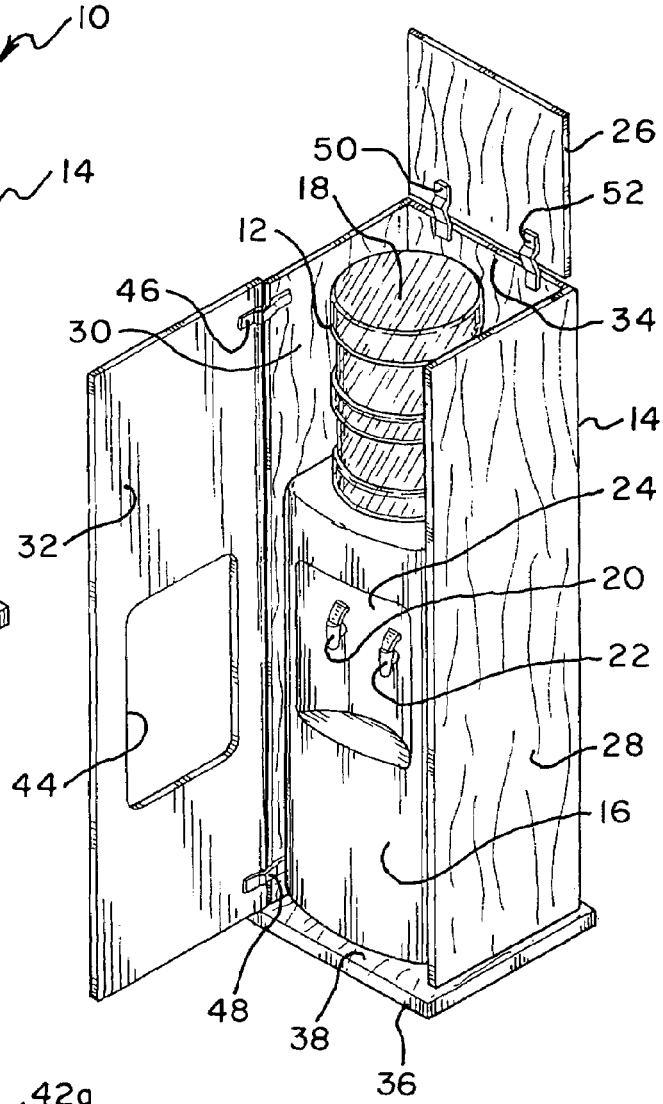
FIG. 2 is a view similar to FIG. 1 but illustrating the cabinet of the present invention in an open state.
Figure 4:
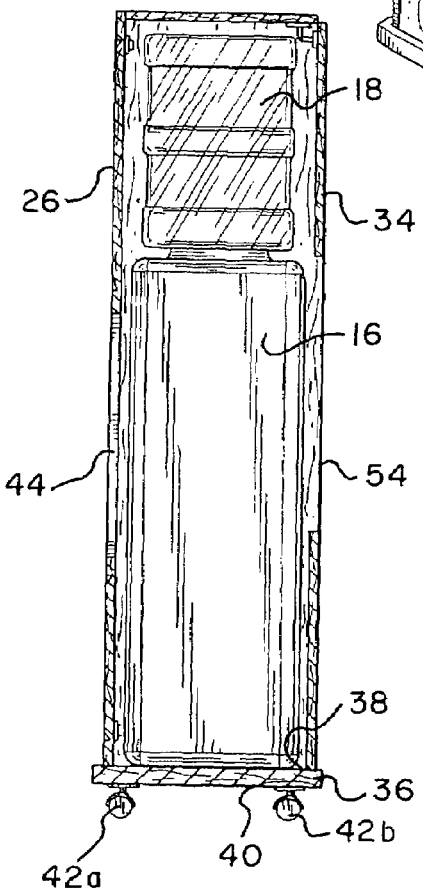
FIG. 4 is a cross-sectional view taken through line 4—4 of FIG. 1.

The system of the present invention essentially includes the combination of a water cooler 12 and cabinet 14 for enclosing the water cooler 12. (See FIG. 4.) The water cooler 12 includes a base 16 and a bottle 18 mounted thereon. As shown, the bottle 18 is a typical five gallon bottle. However, the present system can also be used with six gallon or three gallon water bottles. The base 16 contains an electrical refrigeration system (not shown) and faucets 20 and 22 located in the front face 24 of the cooler 12 for dispensing the water. (See FIG. 2.)

Figure 3:
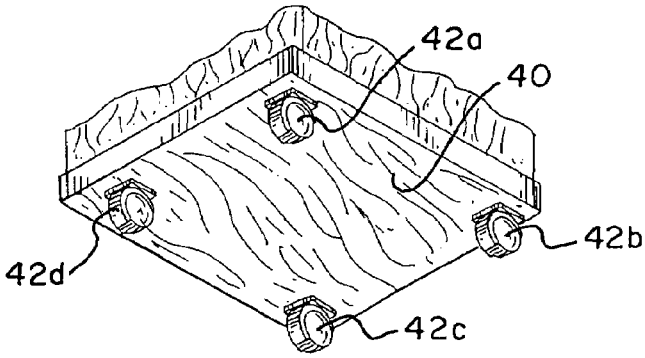
FIG. 3 is a bottom perspective view of the cabinet of the present invention with a water cooler contained therein.
Figure 5:
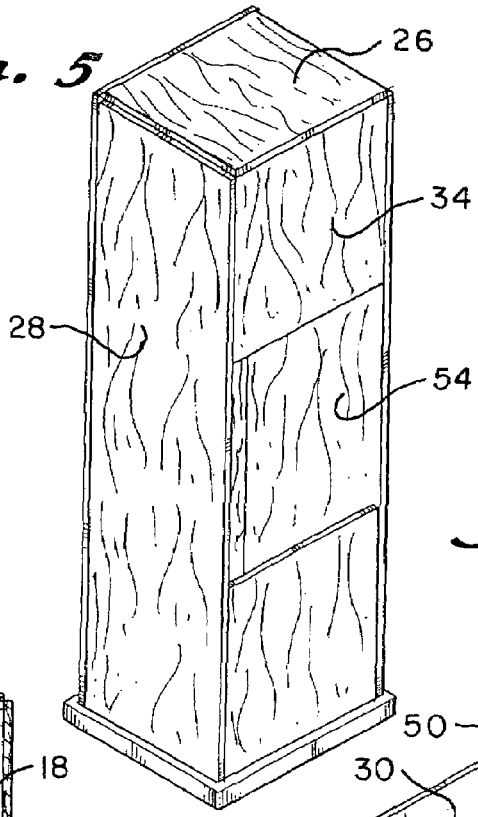
FIG. 5 is a rear perspective view of the cabinet of the present invention.
Figure 6:
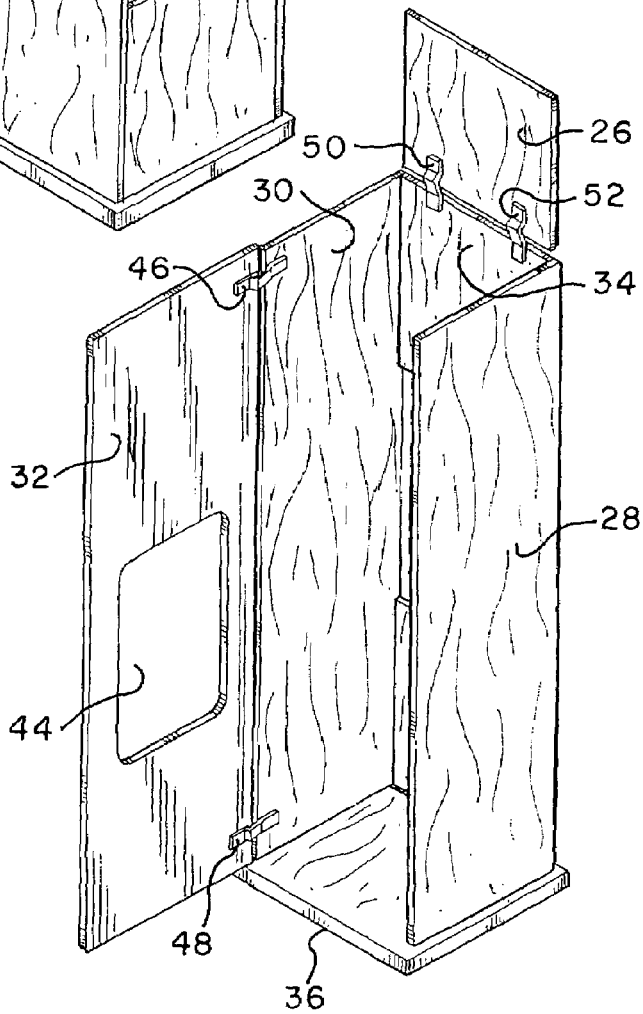
FIG. 6 illustrates the cabinet of the present invention in an open state without a water cooler contained therein.

The cabinet 14 has a top wall or panel 26, a right side wall 28, a left side wall 30, a front door or panel 32, a rear wall 34, and a bottom wall 36. The bottom wall 36 of the cabinet 14 has an inner surface 38 and an outer surface 40. The outer surface 40 has a plurality of wheels 42*a*, 42*b*, 42*c*, and 42*d* mounted thereon. (See FIG. 3.) The front door 32 has an opening 44 through which the faucets 20 and 22 are accessible when the front door 32 is closed. (See FIG. 1.) The front door 32 is hingedly secured to one of the side walls via hinges 46 and 48. Similarly, the top panel 26 is hingedly secured to one of the walls via hinges 50 and 52. (See FIG. 6.) The rear wall 34 has an opening 54 through which the wiring of the electrical refrigeration system may be accessible. (See FIG. 5.)

In order to use the cabinet 14 of the present invention, the top panel 26 and the front door 32 are opened. (See FIG. 6.) A water cooler 12 may then be placed into the cabinet 14. (See FIG. 2.) The wiring of the cooler should extend through the opening 54 of the rear wall 34 so that the plug may be inserted into an electrical socket. The top panel 26 and front door 32 are then closed. The faucets 20 and 22 can be accessed through the opening 44 found in the front door 32, thereby enabling a person to dispense water from the faucets as desired.

In order to replace the water bottle 18, the front door 32 and top panel 26 are opened. The water bottle 18 is then accessible. While the front door 32 and top panel 26 are shown as being hinged to the left side wall 30 and rear wall 34, respectively, it should be realized that variations and modifications may be made without departing from the overall design and function of the cabinet. For example, the top wall may be hingedly secured to a side wall.

The cabinet of the present invention provides a decorative piece of furniture that encloses a water cooler yet allows the water cooler to be used. In addition or in lieu of being a decorative piece of furniture, the front wall or door 32 or either of the side walls can be personalized with a monogram or may carry a company logo or the like. The hinged walls allow the water bottle to be exchanged easily. Furthermore, the wheels of the cabinet allow the cabinet to be moved easily. As a result, the system can be used as a stationary or as a mobile unit.

The present invention may be embodied in other specific forms without departing from the spirit or essential attributes thereof and accordingly, reference should be made to the appended claims rather than to the foregoing specification as indicating the scope of the invention.

I claim:

1. The combination of a water cooler and cabinet for enclosing the water cooler comprising:

a water cooler having a base and a bottle mounted thereon, said base containing an electrical refrigeration system and faucets for dispensing the water and a cabinet having a top wall, a right side wall, a left side wall, a front panel, a rear wall, and a bottom wall, said water cooler being generally enclosed within said cabinet and said front panel being hingedly secured to one of said side walls so as to have an open position and a closed position, said top wall being hingedly secured to one of said side walls, and said bottom wall supporting said base and said bottle thereon wherein said front panel provides access to said base and said bottle of said water cooler when in said open position and said front panel has a single opening through which said faucets are accessible when said front panel is in a closed position.

2. The combination of claim 1 wherein said bottom wall of said cabinet has an inner surface and an outer surface, said outer surface having a plurality of wheels mounted thereon.

3. The combination of claim 1 wherein said rear wall of said cabinet has an opening through which the wiring of said electrical refrigeration system may be accessible.

* * * * *